United States Patent [19]

Bright et al.

[11] 4,142,378

[45] Mar. 6, 1979

[54] CAM CONTROLLED SWITCHING MEANS FOR ICE MAKER

[75] Inventors: James A. Bright, Dayton; Homer W. Deaton, Centerville, both of Ohio

[73] Assignee: General Motors Corporation, Detroit, Mich.

[21] Appl. No.: 856,962

[22] Filed: Dec. 2, 1977

[51] Int. Cl.[2] ..... F25C 1/10

[52] U.S. Cl. ..... 62/135; 62/353

[58] Field of Search ..... 62/135, 335, 132, 136, 62/137, 138, 351

[56] References Cited

U.S. PATENT DOCUMENTS

| | | | |
|---|---|---|---|
| 2,968,166 | 1/1961 | Baker | 62/135 |
| 3,217,510 | 11/1965 | Kniffin | 62/135 |
| 3,308,631 | 3/1967 | Kniffin | 62/135 |
| 3,362,181 | 1/1968 | Linstromberg | 62/135 |
| 3,898,859 | 8/1975 | Duke | 62/135 |

*Primary Examiner*—Reinaldo P. Machado
*Attorney, Agent, or Firm*—Edward P. Barthel

[57] ABSTRACT

An automatic ice maker mechanism includes a face cam on a timing motor driven disc formed with a plurality of concentric cam tracks. The disc is supported on one side of a circuit board, said board having a plurality of flexible blade switches cantilever supported on its other side. The mechanism further includes a plurality of slidable cam follower plunger pins each of which is contacted by an associated blade switch such that each pin is biased into spaced follower relation with one of the cam tracks. In operation the circuit board control circuit interconnects ice maker cycling means with the motor to initiate rotation of the disc whereby the cam track profile effects predetermined movement of its associated pin in one direction causing the contact on an associated blade switch to open with its stationary contact. Continued rotation of the disc results in the blade switch moving its follower pin in the opposite direction reclosing the contacts such that selected functions of the ice maker are performed in a predetermined sequence.

3 Claims, 23 Drawing Figures

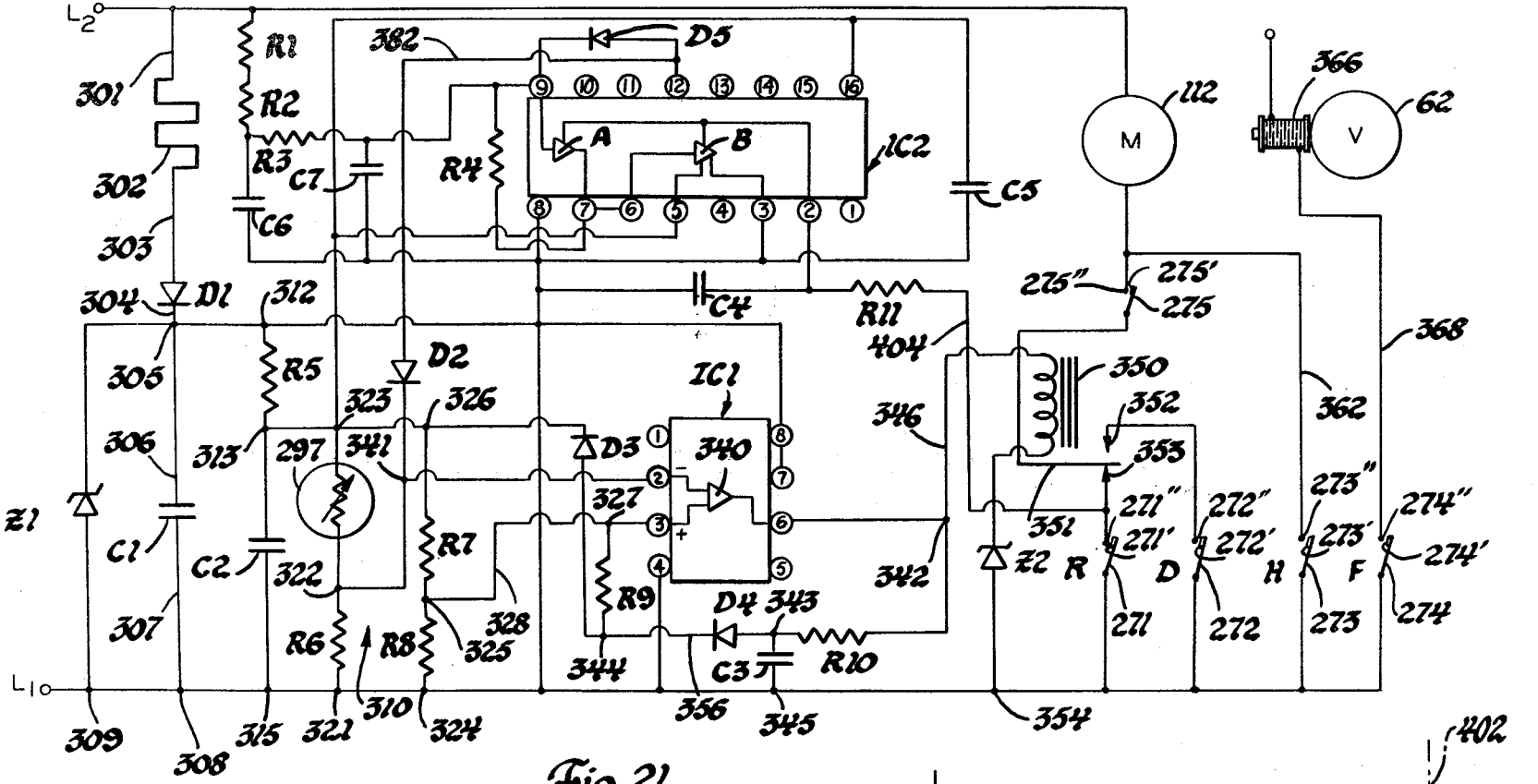
Fig.21
Fig.22
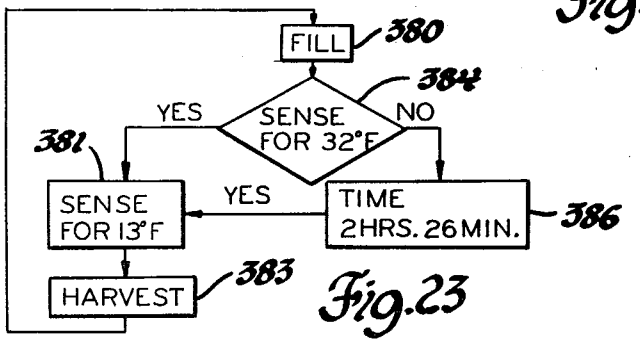
Fig.23

CAM CONTROLLED SWITCHING MEANS FOR ICE MAKER

This invention relates to automatic ice makers and is directed to a face cam switching arrangement operating cantilevered flexible blade switches supported on a circuit board. While automatic ice makers for household refrigerators have been commercially successful, as evidenced by the automatic ice maker shown in the U.S. Pat. No. 3,540,227, issued Nov. 17, 1970 to Eyman, Jr., et al, there exists a need to incorporate circuit board technology in combination with the electrical control circuits operating such ice makers. One such ice maker is disclosed in U.S. Pat. No. 3,308,631 to Kniffin, issued Mar. 14, 1967 and assigned to the assignee of the present application.

It is an object of the present invention to provide an improved automatic tray ice maker in which a circuit board is used to incorporate electronic circuitry for the ice maker control system. A timer motor driven disc member has one surface formed with a plurality of concentric cam tracks arranged to track an associated cam follower plunger pin supported for reciprocal movement relative to the circuit board so as to engage an associated resilient blade switch cantilever supported thereon, whereby each follower pin is urged in one direction by its associated blade switch into first spaced follower relation with its associated cam track, and each cam track formed with a profile effecting predetermined movement of its associated pin in the opposite direction into second engaged follower relation, causing the contact on its associated blade switch to move out of engagement with its stationary contact in response to rotation of the disc, and upon continued rotation of the disc the cam rack profile allows the blade switch to return the follower pin to its first position causing the blade switch movable contact to again engage its stationary contact resulting in selected functions of the ice maker being performed in a predetermined sequence.

This and other objects and advantages of the present invention will be apparent from the following description, reference being had to the accompanying drawings, wherein a preferred embodiment of the present invention is clearly shown.

In the drawings:

FIG. 21 is the ice maker schematic diagram;

FIG. 22 is a cam angle chart for the ice maker; and

FIG. 23 is a flow diagram of the circuit logic.

Figure 1:
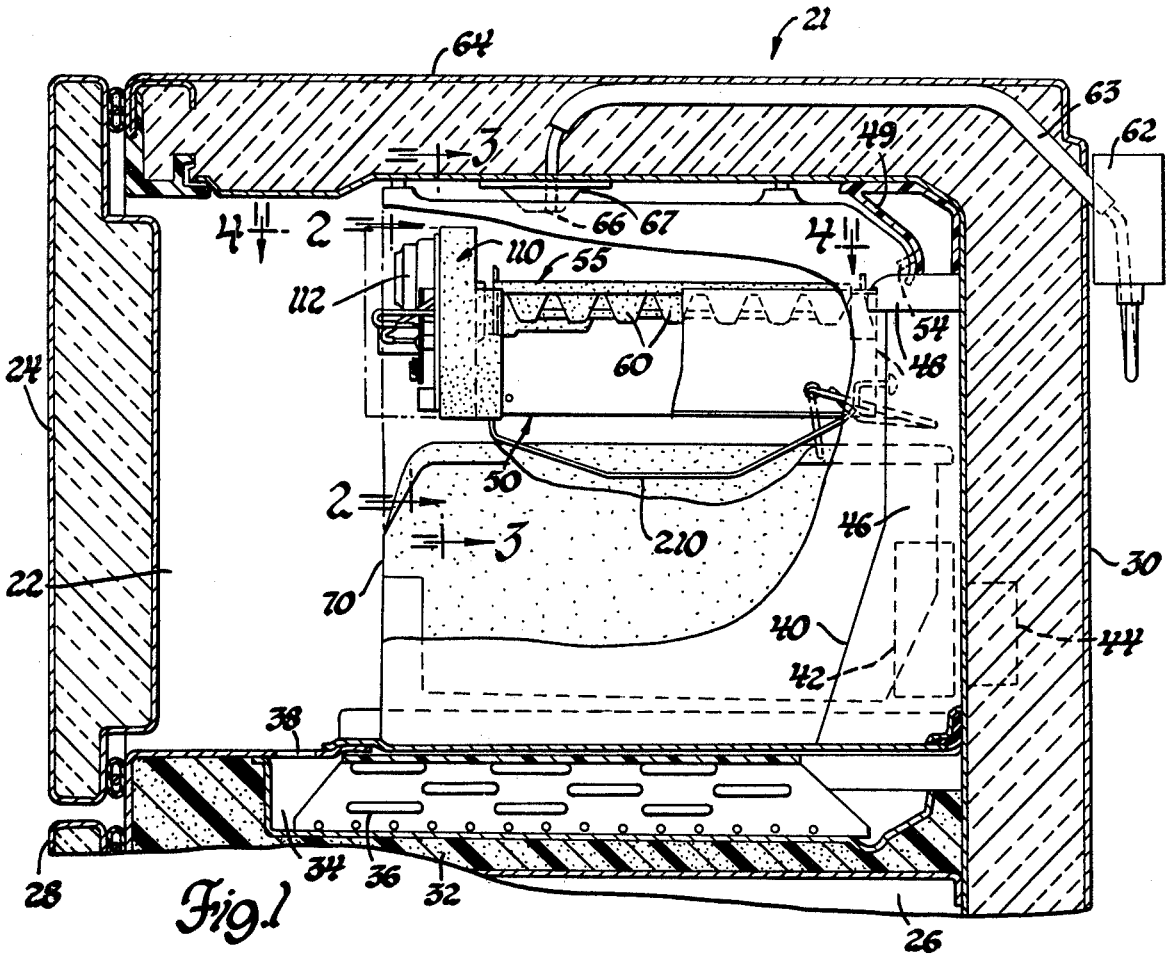
FIG. 1 is an irregular vertical sectional view through a refrigerator freezer compartment embodying the invention.

Referring now to the drawings and more particularly to FIG. 1, there is shown the upper portion of a frost-free household refrigerator 21 with an upper below-freezing compartment 22 closed by an insulated door 24 and a lower above-freezing compartment 26 closed by a lower insulated door 28. These compartments are surrounded by insulated side, top, bottom and rear walls 30 separated by horizontal insulated partition wall 32 incorporating an evaporator compartment 34, supporting an evaporator 36 having vertical fins extending from the front to the rear of the compartment 34. The evaporator compartment 34 is provided with an inlet 38 at the front communicating with the front of the below-freezing compartment 22 and additional inlets (not shown) communicating with the top of the above-freezing compartment 26. At the rear, the evaporator compartment 34 connects with a shroud 40 communicating with the entrance of a centrifugal fan 42 which is driven by an electric motor 44 housed in the rear wall of the cabinet. The cooling system for the compartments 22 and 26 may be of conventional construction such as that shown in U.S. Pat. No. 3,359,750, issued Dec. 26, 1967 or U.S. Pat. No. 3,310,957, issued Mar. 28, 1967, owned by the assignee of the present application. These patents may be referred to for further details of construction of the refrigerator.

The fan 42 is provided with an upwardly extending discharge duct 46 having a distributor 48 at the top which distributes the discharge of chilled air through the below-freezing compartment 22. Evaporator 36 is operated at suitable below-freezing temperatures in the range of −5° to −15° F. to maintain the freezer compartment 22 at a temperature of 0° F. or below.

Special cooling for the freezer compartment 22 is provided in the form of discharge duct 49 extending laterally along the intersection of the rear and top walls in communication with the distributor 48. Behind the automatic ice maker, generally indicated at 50, the laterally extending duct 49 is provided with a wide discharge nozzle 54 which distributes cold air evenly such that it flows over the top of a plastic ice piece forming mold or ice tray 55.

Figure 4:
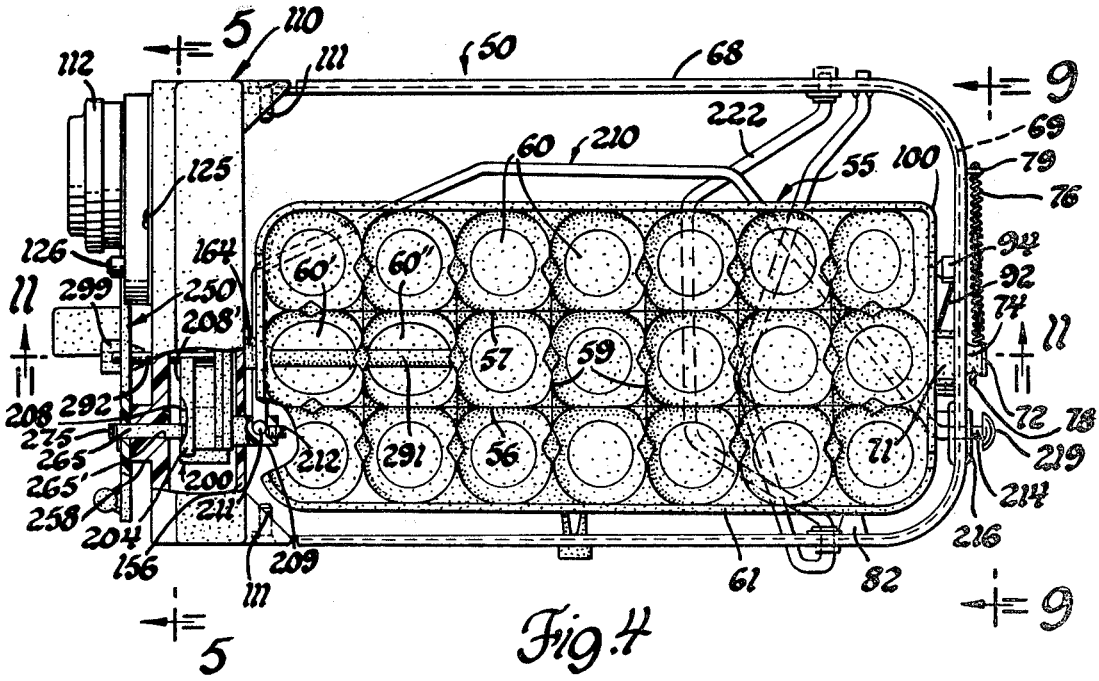
FIG. 4 is an enlarged elevational view taken on line 4—4 of FIG. 1 of the automatic ice maker with parts broken away.
Figure 11:
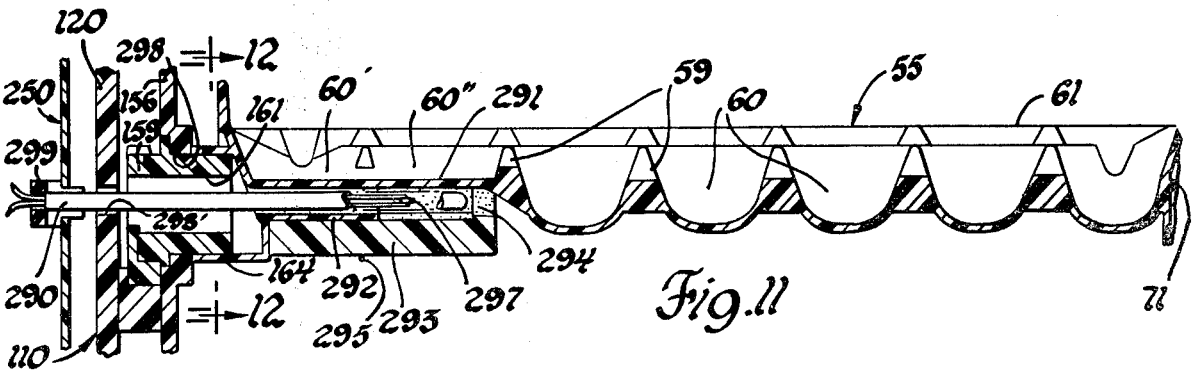
FIG. 11 is a fragmentary sectional view taken on line 11—11 of FIG. 4.

In the disclosed embodiment of FIGS. 1, 4 and 11, the tray 55 has a pair of longitudinal dividing walls 56 and 57 and six transverse dividing walls 59 which section the interior of the tray into twenty one cavities or pockets, i.e. three longitudinal rows each having seven pockets 60. The tray 55 has an upwardly flanged rim 61 extending around its short and long sides while liquid or water to be frozen is supplied from a pressure water system. The tray 55 is supplied with water from a pressure water system to a solenoid control valve 62 which controls the flow of water through tube 63 extending through the insulation of top wall 64 to position a discharge nozzle 66. The nozzle 66 extends through a heater bracket 67 so as to be positioned above the front center pockets of the tray 55.

Figure 3:
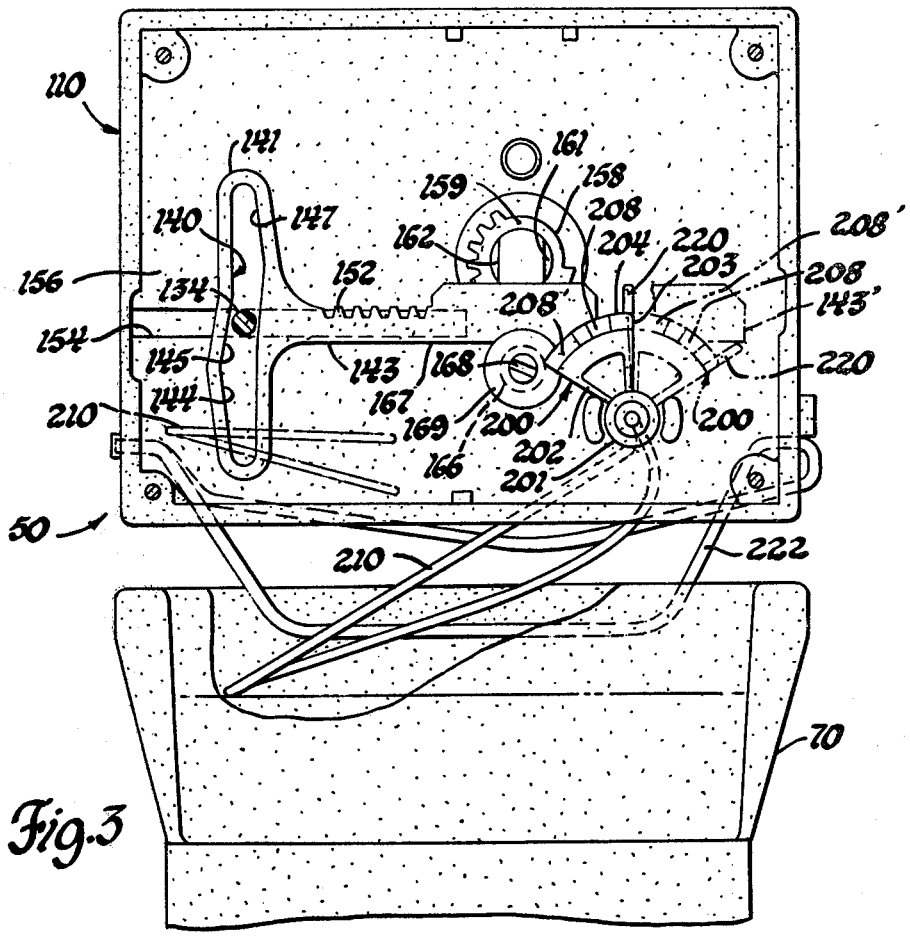
FIG. 3 is an enlarged fragmentary vertical elevational view of FIG. 1, taken along the line 3—3 of FIG. 1.

As seen in FIG. 4, the ice maker 50 is provided with a wide U-shaped frame 68 which surrounds the tray 55. The frame 68 may be fastened to the adjacent liner side wall of the freezing compartment 22 by suitable fastening means such as screws (not shown). In FIGS. 1 and 3 there is shown seated directly below the frame 68 a rectangular bin or ice container 70 for receiving the frozen ice pieces or "cubes" ejected from the tray 55 in a manner to be described.

Figure 9:
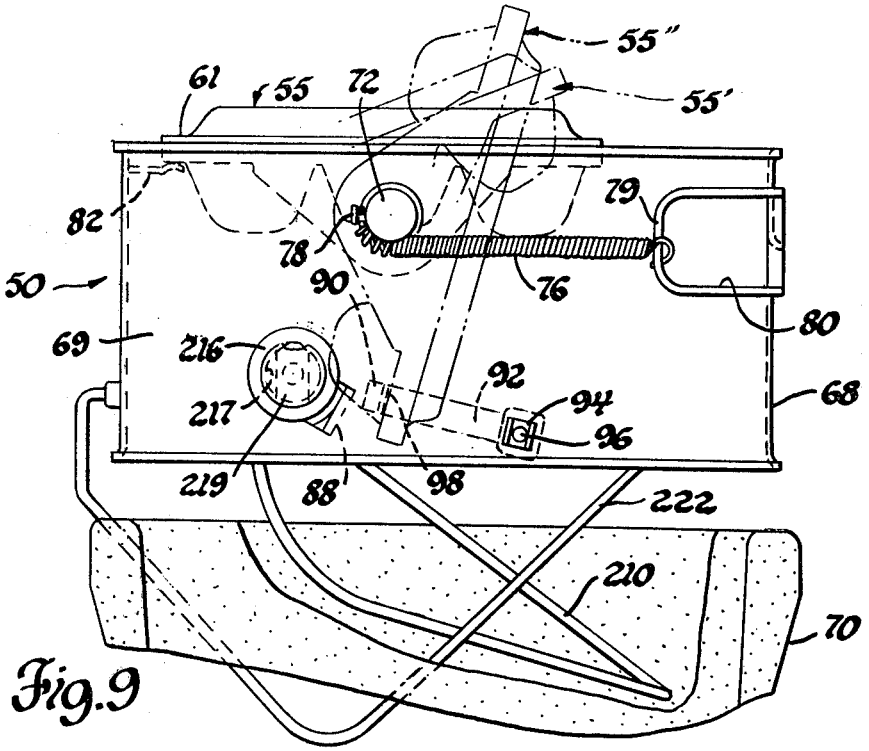
FIG. 9 is a view taken on line 9—9 of FIG. 4.

With reference now to FIGS. 4 and 11, integrally molded on the back wall of tray 55 is a boss 71 provided with a recess tightly receiving a flattened cylindrical portion of a coaxial projecting pin 72 having a forward bearing portion (not shown) fitting a bearing aperture in the rear wall 69 of the frame 68. The pivot pin 72 rearward portion located outside the frame is provided with an annular groove 74 around which is wrapped a portion of a tension coil spring 76 with the spring having one end hooked by means of hook 78 projecting from the groove 74, and with the opposite end of the spring 76 hooked to a lanced-out tab 79 on the rear wall of the frame 68 adjacent a horizontally disposed slot 80. The frame may also be provided with a stop 82 which is lanced out of the frame side wall for extending into the path of movement of an adjacent portion of the tray rim 61 to stop the tray rotation in a horizontal position in the direction of the turning force applied by the tension spring 76. The frame 68 also has a stop 88 which is lanced out of its rear wall and extends into the path of movement of the tray 55 in the direction opposite to the pull of the spring 76 to limit the inverting movement of the rear of the tray to a predetermined angle which, as seen in FIG. 9 of the preferred embodiment is about 120° of rotation upon contacting stop 88.

As explained in U.S. Pat. No. 3,540,227 to Eyman, et al, to further insure the complete ejection of all frozen liquid from the tray 55 during a "second twist", a spring detent generally indicated at 90 in FIG. 9 is provided which comprises a leaf spring 92 secured on the inside of the frame 68 by a plastic spacer insert 94 and expanding screw 96. The leaf spring main portion extends at an angle of about 30° toward the tray and terminates in a Z-shaped end portion 98. The tray 55 has a small radiused rear corner 100 (FIG. 4) shaped to ride out of the "Z" 98 in a "sudden" manner and under the resilient force provided by a predetermined twist, of the order of about 28° of twist, the plastic tray accelerates into contact with stop 88 to assist in the ejection of the ice pieces from the tray 55.

As viewed in FIGS. 1 and 4, all the mechanism and controls for the automatic ice maker 50 are arranged so as to be accessible at the front of the refrigerator with the tray rotating and twisting mechanism being located in mechanism housing 110 suitably secured to the frame 68 as by screws 111. An electric driving motor 112 and an electrical circuit board assembly are enclosed by a removed outer housing cover indicated by phantom lines 116 in FIG. 6. The outer cover 116 and housing 110, both of which are formed from suitable plastic material, define a rear compartment 122 and a front compartment 124. The drive motor 112 is supported by screws 125 on the cover plate 120 with the motor final drive shaft 126, which extends through the cover plate 120, having a drive pinion gear 128 on the opposite side of the cover plate which gear 128 continually meshes with a large driven disc member or crank gear 130.

Figure 5:
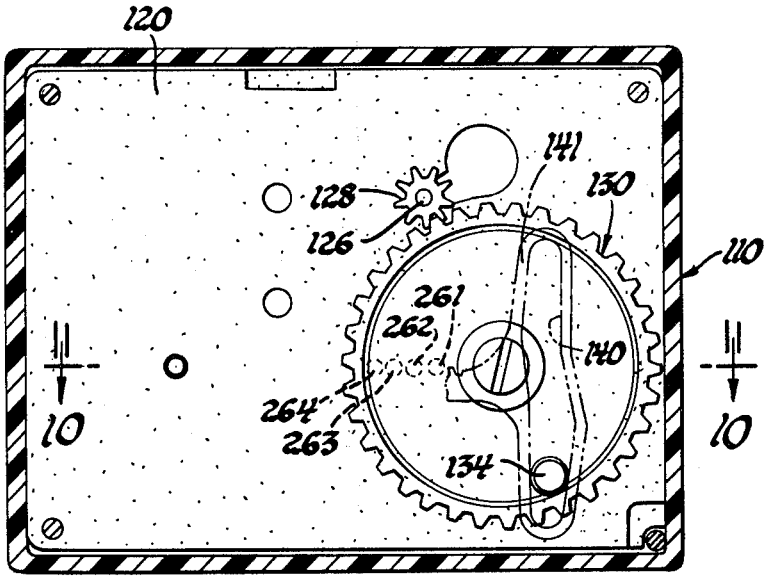
FIG. 5 is an enlarged vertical sectional view taken on the line 5—5 of FIG. 4.
Figure 6:
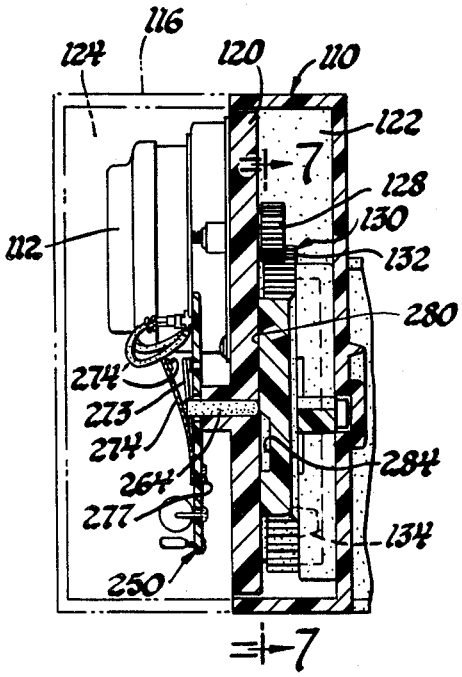
FIG. 6 is an enlarged fragmentary vertical sectional view taken on the line 6—6 of FIG. 2.

As best seen in FIGS. 5 and 6, the large gear 130 rear face 132 is provided with an eccentrically located crank pin 134 which extends into an elongated irregular loop 140 of an upright yoke 141 molded integrally with a horizontal rack bar 143 in a manner similar to a scotch yoke mechanism. As explained in the U.S. Pat. No. 3,926,007 issued Dec. 16, 1975, to R. S. Braden et al, and assigned to the assignee of the present application, the difference from a true scotch yoke mechanism resides in the fact that the surfaces of the yoke loop 140, contacted by the crank pin 134, are not all perpendicular to the rack bar, and in particular the yoke includes angular cam surfaces 144 and 145 in the side opposite the bar 143 and an inclined surface 147 on the side adjacent the bar 143. The rack bar 143 includes six full teeth 152 adjacent to the yoke.

The rack bar 143 is slidably mounted in a horizontal groove 154 provided in the adjacent rear wall 156 of the rear housing 110. The rack bar 143 and its teeth 152 cooperate with an interrupted pinion 158, provided on the front end of a coaxial pinion or spur gear sleeve 159 which sleeve is rotatably mounted in bearing means provided in the housing rear wall 156. The sleeve 159 has a coaxial rearward hollow projection 161, having flattened side inner surfaces 162 and flattened side outer surfaces (not shown) which fit within a boss 164 (FIGS. 12 and 4) located in longitudinal alignment with the center row of pockets 60 of the mold 55 and containing a complementary recess receiving the projection 161. The rack bar 143 is held in engagement with the pinion 158 by suitable means such as bushing 166 contacting the bar's bottom surface 167. The bar 143 is retained by bushing screw 168 threading into the housing rear wall 156 with screw washer 169 guiding the outer surface of the bar 143.

As explained in the mentioned Braden et al patent the crank pin 134 cooperates with the yoke loop 140, via rack bar teeth 152 at the left hand end of the bar's stroke (FIG. 3) an initial reverse twist of about 28° to the front end of the tray 55, indicated in phantom at 55' in FIG. 9. The mechanism cooperates after the initial twist to rotate and invert the tray 55 until after about 140° the rear of the tray 55 engages the stop 88. The rotation continues to finally twist the tray until it completes a twist of about 28° opposite to the initial twist.

As best seen in FIGS. 3 and 4, a sensing arm holder and camshaft member, generally indicated at 200, includes a hub 201 formed with a pair of radially extending spokes 202 and 203 supporting an integral arcuate cam carrier 204. An arcuate cam track 208 is formed on the forward face of the cam carrier 204 including an arcuate raised cam lobe 208' portion thereon. The cam shaft 200 hub has a stub shaft 209 pivitally received in a circular opening in the housing rear wall 156 with the shaft 209 including a transverse bore extending therethrough, receiving the outer radial end 211 of an ice level sensing and shutoff arm 210 retained in the bore by suitable means such as an adjusting set screw 212. As seen in FIG. 4, the rearward free end 214 of the arm 210 is pivotally mounted in the frame rear wall 69 by suitable means such as a plastic grommet 216 inserted in the aperture 217 such that the sensing arm end 214 is in axial alignment with the stub shaft 209. A removable retaining button 219 is inserted on the sensing arm free end 214 for permitting the disassembly thereof.

As seen in FIG. 3, as the rack bar 143 moves to the right it engages radial finger 220, formed as an extension of radial camshaft spoke 203, causing the finger 220 to be rotated to its dashed line position. This movement in turn rotates the sensing arm 210 through a predetermined arc of about 30° from its gravity biased solid line lower portion to its upper retracted dashed-line position free of the ice bin. It will be noted that in unison with the raising of arm 210 the ice tray 55 is rotated clockwise, as viewed in FIG. 9, to its forward twist and ice cube ejection position, allowing the freed ice cubes to fall from the tray into the bin 70.

Upon the rack bar 143 being returned to its FIG. 3 location, by means of the crank pin 134 and the yoke arrangement returning the tray 55 to its horizontal position, the sensing arm 210 is free to rotate in a downward arc from its retracted upper position to its solid line lower position in the bin 70. If, however, the ice piece accumulation in the bin 70 has reached a predetermined maximum level, the sensing shut-off arm 210 is stopped by the ice pieces, therefore preventing the sensing arm arcuate cam from closing an ice level switching arrangement to be described. Thus, the ice maker cannot now initiate a harvest cycle until the sensing arm 210 is free to drop or fall to its full line position and actuate the switching arrangement. A torsion spring rod 222 provides for automatic shutoff of the ice maker when the bin 70 is withdrawn from the freezer compartment by retracting the sensing arm from the bin as shown and described in U.S. Pat. No. 3,926,007 issued Dec. 16, 1975 and assigned to the assignee of this application.

Figure 2:
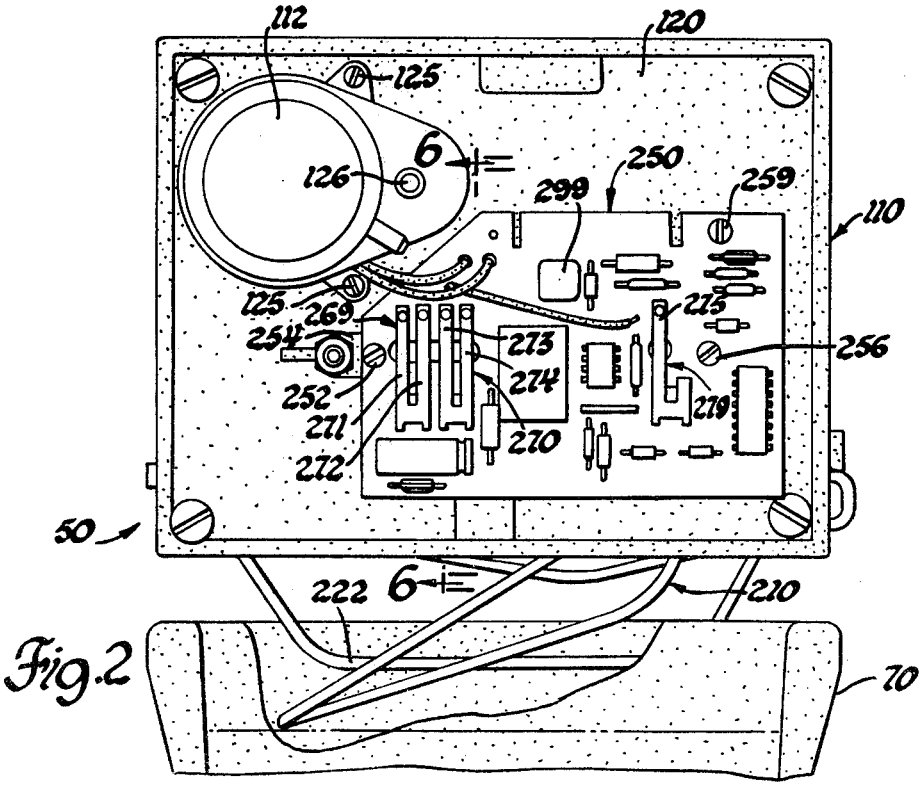
FIG. 2 is an enlarged fragmentary vertical elevational view taken along the line 2—2 of FIG. 1.

As seen in FIG. 2, the circuit portion of the improved automatic ice maker of the subject invention is incorporated in an insulator circuit board generally indicated at 250, fixably mounted by means of screw 252 secured in embossment 254 extending outwardly from the housing cover plate and screw 256 secured in a similar embodiment 258 (FIG. 9) together with a third screw 259 in an embossment (not shown). The board 250 is provided on its inner side or face (not shown) with an electric conductive printed circuit and carries or has mounted on its outer surface various electronic components and switching members to be described.

Figure 10:
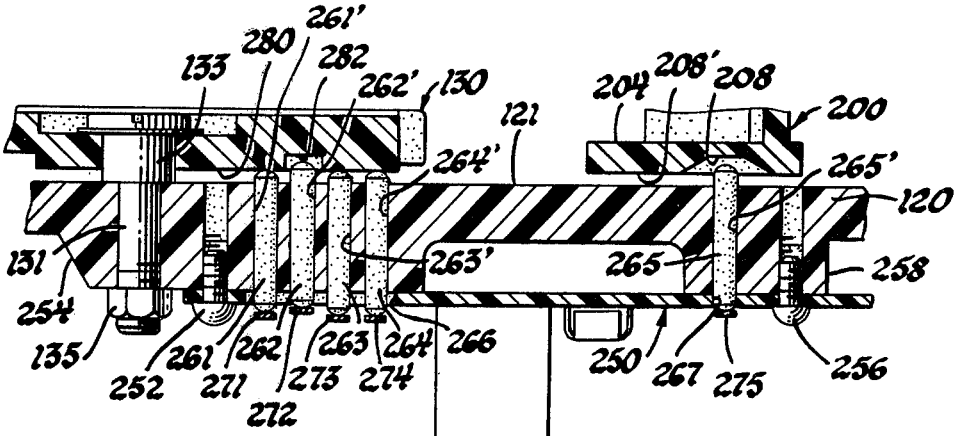
FIG. 10 is an enlarged fragmentary horizontal sectional view taken on the line 10—10 of FIG. 5.

As seen in FIG. 10, the cover plate embossment 254 is elongated and provides a plurality of axial bores which in the disclosed form are shown as four equally spaced bores 261'-264' arranged with their centers in a horizontal plane. Each of the bores 261'-264' receives a movable switch operating cam follower plunger pin 261-264 therein, preferably formed of plastic material, arranged for slidable reciprocation within its associated bore. Each pin has a rounded outer end extending through circuit board elongated opening 266 a predetermined amount so as to be biased inwardly by an electrically conductive flexible leaf spring blade or arm and a rounded inner end for following a cam track profile to be described.

Figure 8:
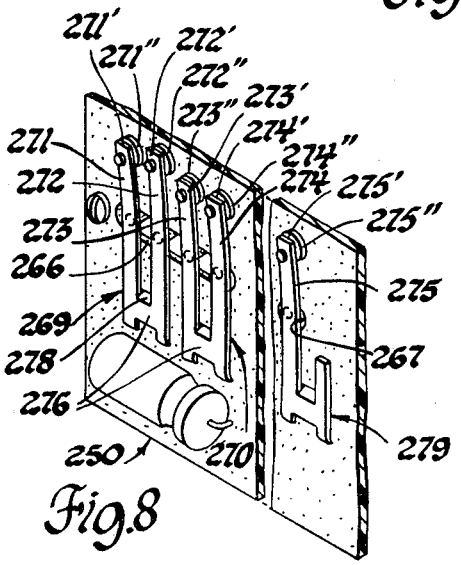
FIG. 8 is a fragmentary perspective view of the circuit board.

Referring now to FIGS. 2, 8 and 10, the circuit board 250 has first and second double switch contact assemblies 269 and 270 providing four cantilever mounted blades of flexible copper material defining blade switches shown at 271, 272, 273 and 274. The identical double switch contact assemblies 269 and 270 each include a substantially flat connecting portion 276 having a pair of lower right angle flanges 277 (FIG. 6) and a central tongue member 278 operative to extend through circuit board openings for mounting the switch assemblies thereon. Each blade switch 271-274 provides a force causing its free end to move toward the circuit board or to the right, as viewed in FIG. 6. The movable contacts 171'-174', mounted at the free end of each switch 271-274 respectively, are biased to close in electrically conductive relation with their associated stationary electrical contacts 171"-174" securely affixed on the outer face of the circuit board 250. Thus, for example, FIG. 6 shows switch movable contact 273' in abutting closed contact with its associated stationary board contact 273". A third single switch contact assembly is shown at 279 in FIGS. 8 and 10 which is similar to the assemblies 269 and 270 with the exception that assembly 279 has a single flexible blade switch 275 which carries a movable contact 275' at its free end for engagement with stationary contact 275" on the circuit board 250. Associated with switch 275 is a cam follower plunger pin 265 for slidable reciprocation within bore 265' in embossment 258. The pin 265 has a rounded outer end extending through circuit board opening 267 a predetermined distance so as to be biased inwardly by the arm of blade switch 275 causing its rounded inner end to follow arcuate cam track 208.

It will be noted in FIGS. 8 and 10 that the single polesingle throw blade switches 271-274 are bowed outwardly from the plane of the circuit board 250 such that an intermediate point of each blade switch is in abutment with the outer end of their associated plunger pins 261-264, respectively. This results in the inner end of the pins 261-264 being urged toward their fully retracted positions, relative to the cover plate 120, projecting a preset distance beyond the inner surface 121 of the cover plate so as to be biased into cam follower relation with their associated annular face cam track integrally molded on the rear surface of crank gear 130. The crank gear is rotatably supported on a bearing pin 131 through a bearing 133 in cover plate 120 and is provided with a suitable retainer such as nut 135.

Figure 7:
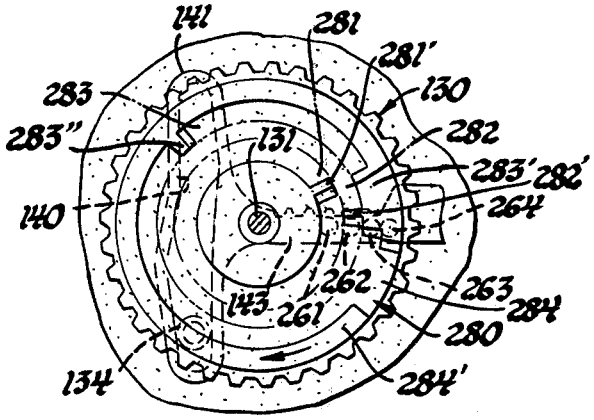
FIG. 7 is an enlarged fragmentary sectional view taken on the line 7—7 of FIG. 6.

As seen in FIGS. 7 and 10, the face cam 280 includes four annular concentric cam tracks 281, 282, 283 and 284, numbered in the order of increasing radius, i.e. with the annular cam track 281 being the innermost and the annular cam track 284 the outermost. The blade switch 271 provides the ice maker "reset" switch with its associated plunger pin 261 inner end tracking or following the first annular face cam track 281. The blade switch 272 functions as the ice maker "delay" switch with its associated plunger pin 262 inner end following the second annular face cam track 282. Blade switch 273 functions as the ice maker "hold" switch by engaging the third plunger pin 263 so that its inner end is biased into cam following position with the third annular cam track 283. Lastly, the blade switch 274 functions as the ice maker "fill" switch by biasing the fourth plunger pin 264 into cam following position with the fourth outermost annular cam track 284.

The operation of the face cam tracks 281-284 will be apparent from a study of the operational cam diagram of FIG. 22 together with FIGS. 6 and 7. With respect to the diagram, it may be noted that the face cam is configured to provide a planar clearance or datum surface common to each of the four cam tracks 281-284 (FIG. 6). The program on each face cam track is imparted to its associated blade switch 271-275 by virtue of the inner ends of the plunger pins 261-264 being maintained by their associated leaf spring switch arm in predetermined spaced relation with the face cam clearance tracks 281-285 resulting in positive closure between the switch movable contacts 271'-274' and stationary contacts 271"-274", respectively. Thus, upon rotation of the crank gear face 280 from its 0° cam angle to about 16°33' the "reset" switch 271 is open as its plunger pin 261 is displaced outwardly, similar to pin 264 in FIG. 6, by cam track protuberance or lobe 281'. As the face cam continues to rotate the plunger pin 261 is moved inwardly to its position spaced from cam track portion 281 allowing the reset contacts 271' and 271" to close. In a similar manner the "delay" plunger pin 272 clears its cam track datum surface 282 from the 0° cam angle to its cam lobe 282' positioned between about 340° 47' and 350° 30'. The "hold" plunger pin 273 contacts its cam track lobe 283' from about 0° to 9° 18' and from about 335° 03' to 360° while cam track 283 has a second lobe, indicated at 283", extending from about 109° 28' to 121° 33". The outermost cam track 284 for the "fill" plunger pin 274 has a lobe 284' which extends from about 0° to 304° 14' and from about 328° 18' to 360'. It will be noted that each of the face cam lobes has a steep ramp portion (FIG. 6) leading to a raised planar portion designed to provide immediate response upon the ramp contacting its associated plunger pin whereby said pin will be moved outwardly to open its related switch.

As shown and explained in the U.S. Pat. No. 3,926,007 with the ice container removed the torsion spring rod V-shaped cam portion (FIG. 9) engages the sensing arm 210 and rotates it up and out of the container 70. As a result the sensing arm holder 200 and cam carrier 204 are rotated to their dotted line position of FIG. 4 wherein cam lobe 208' operates to extend plunger pin 265 and flex or lift the ice level sensing blade switch 275 away from its fixed contact 275" thereby opening the ice level switch (FIG. 16) to prevent an ice harvest whenever the ice bin or container 70 is removed from its ice receiving position (FIG. 1). It will be noted that during the ice harvest cycle the gear crank pin 134 starts to move the rack bar 143 slightly to the left, as viewed in FIG. 3, to initially reverse twist the tray 55' and then move the rack bar to its rightmost dashed-line position 143' engaging radial cam finger 220 portion of sensing arm holder 200. The result is the tray is forward twisted to 55", then impacted against stop 88 (FIG. 9) while the ice level sensing arm 210 is rotated up and out of the ice container 70 causing the cam lobe 208' to open the ice level switch 275 (FIG. 17). The cam angle for the ice level sensing arm arcuate cam track 208 of FIGS. 3, 4 and 10 (not shown) has its arcuate lobe portion 208' extending over an arc of about 52°.

Figure 12:
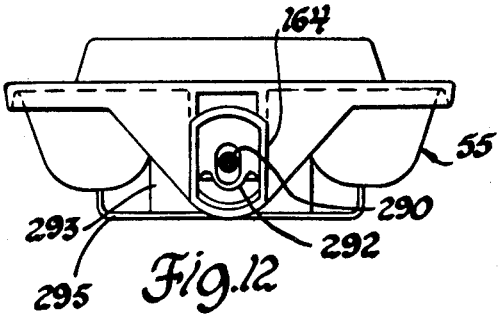
FIG. 12 is a sectional view taken on line 12—12 of FIG. 11.

FIGS. 11 and 12 show axially extending elongated sensing tube 290, preferably made from Nylon, extends into an inverted channel 291 formed in the bottom walls of ice tray pockets 60' and 60". The tube 290 has its intermediate portion telescopically received in an external arcuate wall 292 integral with the tray. Cover means partly defined by plastic insulation block 293 secured by wire member 295 cooperate with the tray in a novel manner defining a thermal well 294 beneath ice tray pocket 60". Temperature sensing means, preferably in the form of a negative temperature coefficient (NTC) thermistor 297, is located near the inner end of tube 290 to sense the temperature of the ice tray pocket 60". One thermistor suitable for the disclosed ice maker has a resistance of 15 to 20 ohms at −10.5° C. ± 3% with a temperature coefficient of −5.5% at ° C.

As seen in FIG. 11, the tube 290 front portion extends forwardly through the hollow projection 161 of spur gear sleeve 159, an aligned opening 298 in housing rear wall 156 and an aligned opening 298' in cover plate 120. The outer end of the tube 290 passes through circuit board 250 and is suitably affixed thereto such as by expanding plastic retainer nut 299 (FIG. 4).

A schematic of the ice maker control circuit is shown in FIG. 21 wherein a power source across lines $L_1$ and $L_2$ provides, via line 301, an alternating current line signal of about 115 VAC to one side of a fill tube heater 302. The heater 302, located in bracket 67 (FIG. 1) prevents freezing of the nozzle portion of the ice tray water fill tube 63. A silicon rectifier D1, having its anode connected to the other side of heater 302 by line 303 and its cathode connected by line 304 to junction 305, is actuated by the induced voltage drop in the heater 302 so as to be conductive for a predetermined period of the full waveform of the AC power supply across the electrical supply lines $L_1$ and $L_2$. Capacitor C1, which has one side connected by line 306 to junction 305 and its other side connected by line 307 to $L_1$ junction 308, filters the pulsating D.C. output from rectifier diode D1 into a relatively smooth flow of current. A Zener diode Z1, connected between junctions 309 and 305, is located in parallel combination with the capacitor C1 and is operative to regulate the voltage applied to the circuit, and prevents the maximum power supplied thereto from exceeding a predetermined voltage. In the disclosed form the voltage upper limit is about 27 volts above line $L_1$ or circuit ground. Thus, the ice maker primary power supply consists of the fill heater 302, the diode D1, the capacitor C1 and the Zener diode Z1.

The output of the power supply is fed to a temperature sensor network including a symmetrical bridge circuit, indicated generally at 310, via power reducing or voltage divider resistor R5, connected between circuit junctions 313 and 315, operative to drop the output voltage of the primary power supply from about 27 volts to about 12 volts. The capacitors C2 and C5 serve as filters for the secondary voltage supply of R5. The bridge circuit 310 includes resistors R6, R7 and R8 and the NTC thermistor 297. The temperature sensor network is responsive to changes in the resistance of the NTC thermistor 297, shown positioned in ice tray well 294 to sense the temperature within the ice tray pocket 60" (FIG. 11), whereby the thermistor transforms resultant changed resistance to an equivalent voltage. The bridge resistor R6, connected between junctions 321 and 322, has a resistance of about 16.9 kilohms in the disclosed form while resistors R7 and R8 are of equal resistance having a value in the present circuit of about 10 kilohms. As seen in FIG. 21 the NTC thermistor 297 is connected between junctions 322 and 323, the bridge resistor R8 between junctions 324 and 325 and the bridge resistor R7 between junctions 325 and 326 of the circuit.

The temperature sensing thermistor 297 is thus connected in one leg of the bridge network 310 such that variations in the resistance of the thermistor 297 cause an unbalanced condition for the bridge circuit 310, providing a D.C. output voltage. The output voltage is extended to logic or switching means in the form of a semiconductor or integrated amplifier IC1 portion of the temperature sensor circuit via junction 325, line 326 and junction 327 with junction 327 in turn connected to the IC1 input terminal three. In the disclosed embodiment the integrated amplifier IC1 comprises a high-gain operational amplifier linear integrated circuit commercially available from Fairchild under the designation MA 741.

A positive feedback circuit, consisting of the series combination of resistor R10, diode D4 and resistor R9; is connected between the output terminal six of IC1 operational amplifier 340 and its non-inverting positive input terminal three. Amplifier 340 has its negative inverting input terminal two connected to bridge terminal 341. The resistor R10 is connected between circuit junctions 342 and 343 while the anode of diode D4 is connected to junction 343. Circuit junction 344 connects the cathode of diode D4 to one side of resistor R9 with the resistor R9 having its other side connected to junction 327. A diode D3 has its anode connected to the junction 344 and its cathode connected to bridge junction 326. The positive feedback circuit is filtered by capacitor C3 connected intermediate junctions 345 and 343. The output terminal six of the IC1 is coupled to junction 342 and thence via line 346 through a relay 350 to the anode of a Zener diode Z2 while the cathode of Z2 is connected to junction 354.

A timer or clock is incorporated in the ice maker circuit to provide time delay means in the form of a counter. In the preferred embodiment the counter consists of a commercially available NOS integrated circuit indicated at IC2 in FIG. 21 including circuit elements A and B. One example of a commercially available integrated circuit suitable for this application is marketed by Motorola under the designation MC14521B 24-stage Frequency Divider. This device consists of 24 flip-flops wherein each flip-flop divides the frequency of the previous flip-flop by two. Consequently with an input of 60HZ the output at its stage 20 provides a total of 146 minutes or a two hours and twenty-six minute timed cycle interval to delay the ice maker harvest cycle.

The IC2 circuit element A is connected at its terminal nine to resistor R3 and at its terminal seven to resistor R4, which together with capacitor C7 provides a Schmitt Trigger pulse squaring circuit. It functions to convert the 60 HZ sine-wave output of a low pass filter circuit, consisting of resistors R1, R2 and capacitor C6 into square waves or pulses. The output of the IC2 circuit element A is fed, via its interconnected terminals seven and six, to the input of IC2 circuit element B the output of which is taken from IC 2 terminal twelve and conducted via line 382 to the anode of blocking diode D2 which operates to short-out the thermistor 297 during the two hour and twenty-six minute time delayed harvest cycle.

The bridge network 310 and semiconductor IC1 operational amplifier 340 which receives its driving or excitation voltage supply at juncture 313 from the voltage dividing resistor R5. The supply voltage at 313 is used to provide power to the integrated circuit IC2 and the bridge network 310. This secondary power supply is necessitated because the IC2 cannot operate from a 27 volt supply as its maximum rating is about 15 volts. Thus, the juncture 323 actually supplies about 12 volts to power both the bridge 310 and the IC2.

With reference to the cam angle chart of FIG 22 it will be seen that with the face cam of gear 130 rotated through an angle of about 342°, represented by construction line 402 in FIG. 22, wherein the ice maker harvest cycle has been completed and the fill period has been completed. In this position of line 402 it will be seen that reset switch 271 is closed while the delay 272, hold 273 and fill 274 switches are open. This position corresponds to the decision block 384 of the flow chart of FIG. 23 wherein the thermistor 297 senses for 32° F. in the tray sensing pocket 60″.

Assuming that pocket 60″ has received a charge of water, indicated by fill block 380, the thermistor 297 will still be cold as a short interval of one or two minutes is required to warm up the thermistor. In this condition the relay switch 351 will still be "pulled in", that is to say switch 351 will be contacting its "cold" contact 352. Thus, upon the delay switch opening the motor 112 will be deenergized holding the face cam 280 at chart line 402 and, in the condition of no stuck cube in pocket 60″, the circuit is waiting for the thermistor 297 to warm to above 32° F. When the thermistor reaches 32° F. the operational amplifier 340 output drops to about three volts which is its low output switching point. The circuit will respond to "drop-out" or deenergize the relay 350 causing relay switch 351 to move to its fixed "warm" contact 353.

With the reset switch 271 closed the motor 112 will be energized rotating the face cam to its 0 degree or starting position causing reset switch 271 to open. It will be noted on the cam angle chart (FIG. 22) that just prior to the reset switch 271 opening the delay switch 272 will have closed to prepare the ice maker for the next harvest. This condition corresponds to the "YES" line or "branch" on the flow chart of FIG. 23 wherein the thermistor 297 has sensed or warmed-up to above 32° F. and is looking or waiting for the thermistor to sense 13° F. at block 381.

With fill water in cavity 60″ the refrigeration system circulates freezing air over the tray 55 for variable time intervals, depending upon the operation of the refrigerator. After a period of about one to one and one-half hours the water in pocket 60″ freezes into an ice cube causing the thermistor 297 to be lowered in temperature to 13° F. ± 3° F. resulting in a harvest switching point for the temperature sensor circuit. This occurs because at about 13° F. the resistance of the thermistor 297 increases above 16.9 K., causing the negative input to the IC1 at pin two to become less than the positive input at pin three resulting in the IC1 output at pin six to suddenly increase to its high state of about 20 volts. The increased voltage energizes the relay coil 350 and moves the relay switch 351 to its "cold" contact 352. As the delay switch 282 is closed at 0° on the cam angle chart the motor 112 will be energized and another ice harvest cycle will commence. Assuming now the case of a stuck cube in sensing pocket 60″ and returning to the line 402 position on the cam chart of FIG. 22, with the delay switch 272 open the thermistor 297 will not warm up after the remaining pockets 60 of the tray have been refilled with water. As a consequence the relay 350 will not be deenergized as the output at pin six of IC1 will remain at its high or 20 volt level preventing the motor from advancing the face cam 280 through its last few degrees, i.e. reset switch 271 will remain closed. With reference to the flow chart the decision block 384 calls for the ice maker to take the "NO" branch.

The counter circuit element B is constantly being supplied with a 60 HZ signal via pin nine, circuit element A, and pins seven and six. Each time the harvest cycle starts, at the 0° position on the cam chart, the reset switch 271 is opened causing a 60 HZ from $L_2$ to be fed through the motor 112, the switch 275, relay switch 351, line 404 and R11 to the reset terminal two of IC2. This signal at reset terminal two returns the counter to zero time and restarts the counter. This starts a predetermined delayed harvest cycle of two hours and twenty-six minutes indicated at operation block 386. It will be noted that the capacitor C4 and resistor R11 operate to filter the reset signal.

After the elapse of the two hour and twenty-six minute delay harvest the ice maker follows the "YES" path from block 386. This is shown in the circuit of FIG. 21 wherein an output signal voltage at terminal pin twelve of IC2 is applied via line 382 to the diode D2 which overrides or shorts-out the bridge network whereby the negative input terminal two goes above the positive input terminal three. This results in the output of the operational amplifier "thinking" that the thermistor 297 is above 32° F. such that its output at terminal six goes low, that is about 3 volts, causing the relay 350 to be deenergized starting the motor 112 to run the last portion of the cycle.

The flow chart then takes the "YES" path to the block 381 where the thermistor 297 is sensing the stuck cube temperature of 13° F. The bridge network causes the amplifier 340 to switch by virtue of its positive terminal three going above the negative terminal two providing a high voltage output to energize the relay 350 and close to its "cold" contact starting a harvest cycle at block 383. After the harvest cycle the flow line returns to the fill block 380.

The temperature sensor circuit is designed to provide two switching set points to enable it to sense a first normal fill cycle wherein the afterfill temperature in sensing pocket rises above 32° F., and a second stuck cube condition wherein an ice cube remains in tray pocket 60'' causing the afterfill temperature to remain below 32° F. Considering first the condition wherein the thermistor 297 temperature is above 32° F. the operational amplifier 340 output at pin six is low or about 3 volts resulting in the relay 350 being dropped-out, i.e. with its switch 351 at contact 353. At this state the diode D4 is reverse biased preventing current flow therethrough causing an "open" condition in line 356 which results in the feedback circuit R9, R10 and C3 being disabled. The bridge network therefore consists of the thermistor 297 and the resistors R6, R7 and R8. Since R7 equals R8 a first switching point for the bridge will occur when it goes through a balance point wherein the resistive value of thermistor 297 at 13° F. ± 3° equals the value of R6 which is about 16.9 K.

As the temperature of the thermistor 297 goes below 13° F. the thermistor resistance increases above 16.9 K. causing the negative input to the operational amplifier 340 at pin two to become less than the positive input at its pin three. This results in the operational amplifier 340 switching to its high state. If proper conditions are met, i.e. ice level switch 275 closed, the ice maker will begin a harvest cycle.

Upon the operational amplifier 340 reaching a high voltage output at pin six, of the order of 20 volts, a current flow is provided through feedback circuit R10, D4 and R9 causing D4 to be forward biased. In this condition D3 clamps selective resistor R9 to within about 0.7 volts of the voltage at juncture 323 and effectively puts resistors R7 and R9 in parallel providing a new equivalent resistance and accordingly a second set point of about 32° F. for the bridge network. Thus, for the operational amplifier 340 to return to its low output state, the negative input at its pin two must again be higher than the positive input at its pin three. This occurs when the thermistor value decreases to about 10 K., which corresponds to the second set point temperature of about 32° F.

OPERATION

The operation of the ice maker cam control system is more easily understood from the diagrams illustrated in FIGS. 13–20. The FIG. 13 diagram shown the "delay" switch 272 in its closed position during the freeze period of the ice maker with the "stop" or "reset" switch 271, the "hold" switch 273, and the "fill" switch 274 in their open positions. At this time the ice tray 55 is in its horizontal fill position (FIG. 9) and with a temperature sensor in the form of thermistor 297 indicating a temperature greater than 13° F. ± 3° F. The single pole-double throw relay 350 is shown with its movable contact arm 351 in contact with its upper fixed contact 351. If during this freeze period, the ice container 70 is removed, torsion spring 222 raises the sensing arm 210 pivoting its holder 200 clockwise. This causes the ice level blade switch movable contact 275' to be lifted from its stationary contact 275'' by virtue of its plunger pin 265 inner end contacting the raised lobe portion 208' of its arcuate cam track 208 preventing an ice harvest from being initiated until the ice container 70 is replaced beneath the ice maker.

Figure 14:
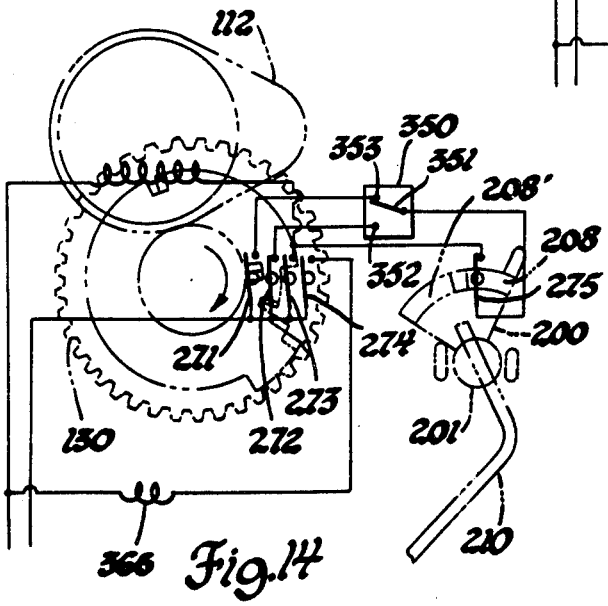
FIG. 14 is a diagrammatic view similar to FIG. 13 with the gage arm in its lowered position in the ice container.
Figure 19:
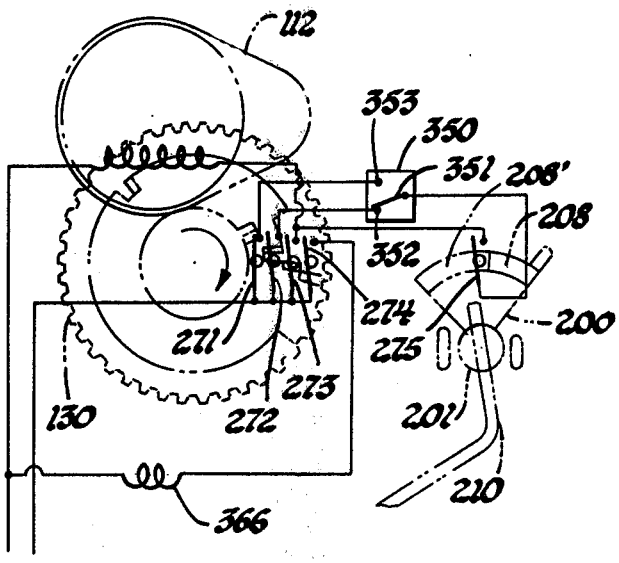
FIG. 19 is a view similar to FIG. 16 with the crank gear face cam in its delay position, and the ice bin full.

FIGS. 14 and 19 show the ice level sensing arm 210 in its gravity biased, downwardly pivoted position within the replaced container 70 with sensing arm holder 200 pivoted counterclockwise. Plunger pin 265 is slidably biased inwardly opposite arcuate cam track 208 by the spring force of blade switch 275 so as to close blade switch movable contact 275' to its fixed contact 275'' allowing an ice harvest cycle to take place.

Figure 15:
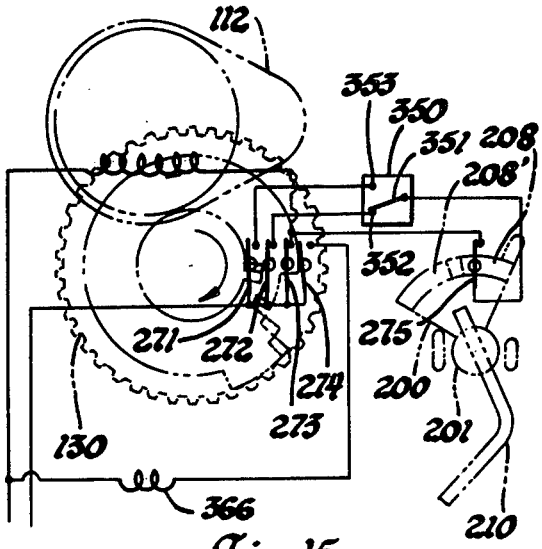
FIG. 15 is a view similar to FIG. 13 with the crank gear face cam in its position to initiate an ice harvest cycle.

Turning now to FIG. 15, the ice maker control circuit is shown in its "initiate Harvest Cycle" position wherein the thermistor 297 has sensed a temperature in tray pocket 60'' of 13° F. ± 3° F. wherein the temperature sensor circuit switches high causing the relay movable contact 351 to be "pulled-in" or moved to its stationary "cold" contact 352. In this position the motor 112 is energized through the closed delay switch 272, relay contact 352, movable switch 351 and movable contact 275' of the ice level switch 275 closed to its stationary contact 275''.

As the cam face 280 is rotated by the motor a few degrees the reset pin 261 engages its annular cam track lobe or protrusion 281'. It will be seen in FIG. 7 that the "hold" cam track 283 is configured such that rotation thereof in a clockwise direction will cause the "hold" plunger pin 263 to ride off the raised arcuate lobe segment 283' relieving the tension on its spring blade switch 273 so as to correspondingly bias the "hold" plunger pin 263 inwardly. This causes the "hold" switch to close by a movable contact 273' engages its fixed contact 273'' on the circuit board 250 as the tray 55 begins its initial reverse twist at the front end of the tray (See phantom line 55' in FIG. 9). The closed hold switch 273 provides an alternate path via line 362 to energize the motor 112 insuring that the motor will not stop during the harvest cycle of the ice maker. The "reset" switch 271 closes with the "hold" switch in the same manner.

Figure 16:
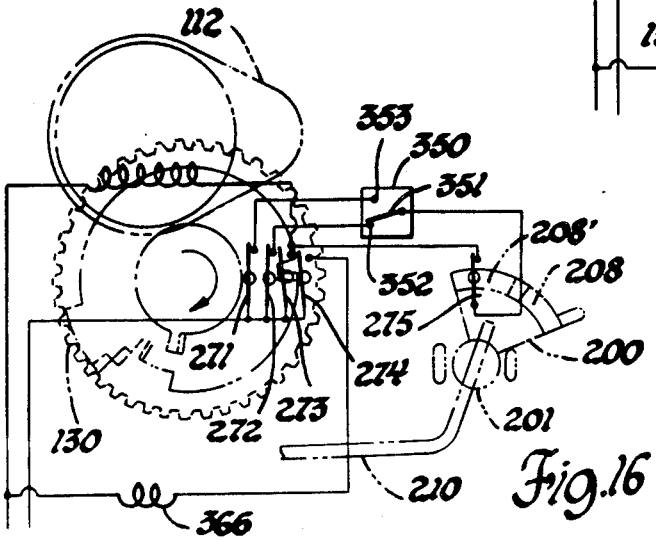
FIG. 16 is a diagrammatic view similar to FIG. 13 with the crank gear face cam in the first half of its harvest cycle.
Figure 17:
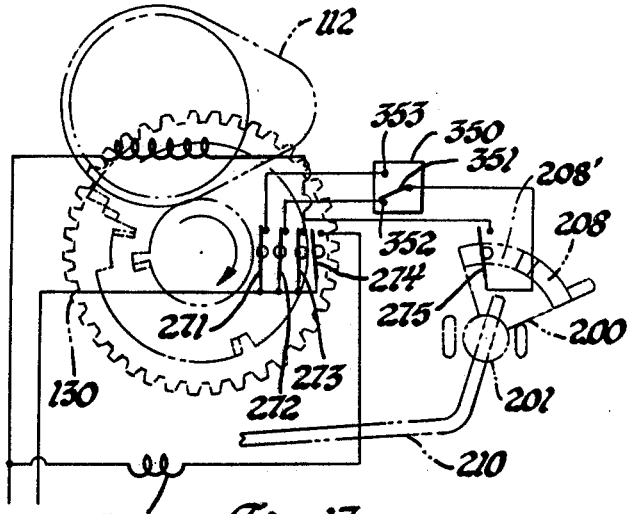
FIG. 17 is a diagrammatic view similar to FIG. 15 with the crank gear face cam in the second half of its harvest cycle.

FIG. 16 shows the first half of the ice harvest cycle, wherein if the ice container 70 is removed before the ice cubes fall from the tray 55, the "hold" switch 273 will open before the tray is inverted, stopping the harvest cycle until the ice container has been returned to its position beneath the ice maker. The arcuate cam lobe segment 283" of the "hold" cam track 283 is responsible for opening the "hold" switch 273 during this portion of the harvest cycle.

FIG. 17 shows a diagrammatic representation of the circuit during the second half of the harvest cycle wherein the hold switch 273 is again closed and the ice level sensing arm 210 is rotated up and out of the ice container 70 thereby opening the ice level switch 275. The crank pin 134 and yoke 141 cooperate after the initial twist 55' of the tray to rotate the tray 55 to its snap spring detent 90, shown by phantom line 55" (FIG. 9) and final twist position so as to eject the released ice cubes into the container 70.

Figure 18:
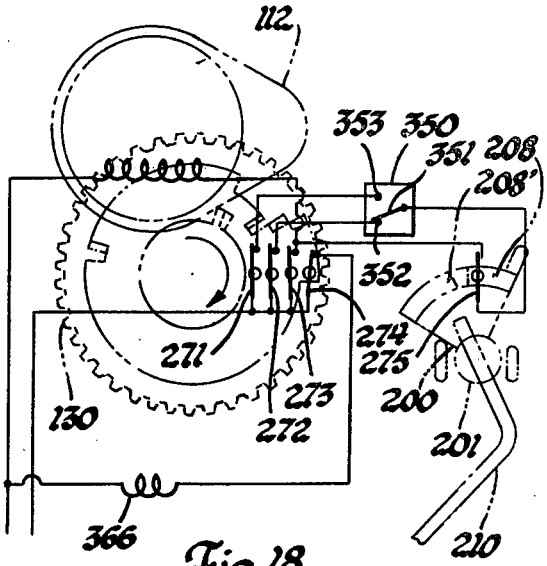
FIG. 18 is a diagrammatic view similar to FIG. 16 with the crank gear face cam shown during the ice tray fill period.

FIG. 18 shows the fill cycle with the tray 55 having been returned to its horizontal position and the fill switch 274 closed energizing fill control valve 62 by means of its solenoid 366 for a predetermined interval, about twelve seconds in the present embodiment, to fill the tray with water to a given level. The fill cycle results from the motor 122, in rotating the fill cam track 284, has caused the plunger pin 264 to drop-off its raised arcuate lobe 284' allowing fill blade switch contact 274' to close on its stationary contact 274" energizing the water valve solenoid 366 via conductor 368. It will be noted that during the fill period all the blade switches 271-274 are closed with the ice level sensing arm 210 having been lowered to its position in the ice bin. Assuming that the ice level in the container 70 is below the sensing arm, the ice level blade switch 275 is closed to its fixed contact.

FIG. 19 shows the delay position of the face cam 280 and switches 271-275 wherein both the hold switch 273 and the delay switch 272 have been opened shortly after the opening of the fill switch 274. With the ice bin 70 full the ice level switch 275 will open and the motor 112 stops until the ice level is lowered allowing the ice level switch 275 to return to its closed position.

Figure 13:
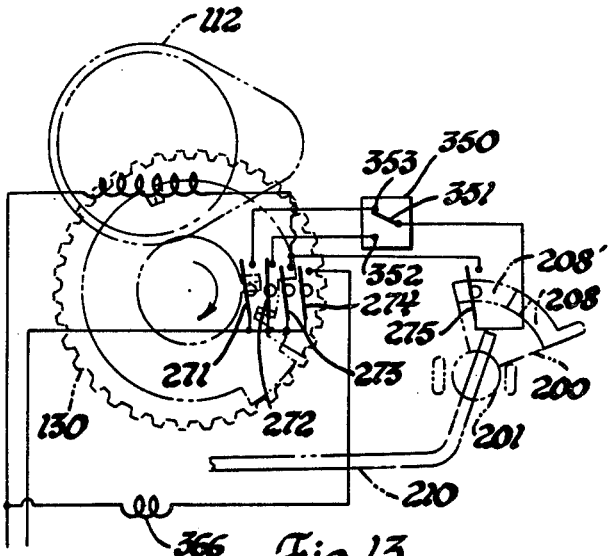
FIG. 13 is a diagrammatic view showing the crank gear cams for the control system at the beginning of a freeze period.
Figure 20:
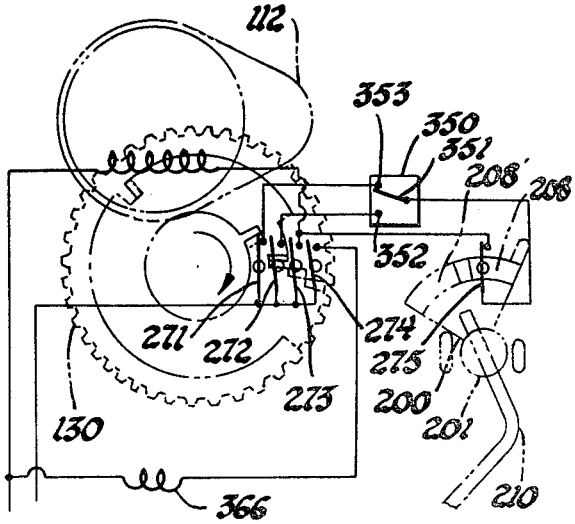
FIG. 20 is a view similar to FIG. 18 with the crank gear face cam in its delay position and the ice container not full.

FIG. 20 shows the delay position, represented by construction line 402 on the cam angle chart of FIG. 22 wherein the fill switch 274, the hold switch 273 and the delay switch 272 are open. As the ice bin is not full of cubes the ice level switch 275 is closed. If the thermistor senses a temperature above 32° F. the relay 350 switches to its warm contact 353 as explained above and indicated by the "YES" path leading from the decision block 384. If the thermistor temperature remains below 32° F. the relay 350 switches to its "warm" contact 353 after two hours and twenty-six minutes. The motor 112 then runs until the reset switch 271 opens to begin the freeze period (FIG. 13).

While the embodiment of the present invention as herein disclosed constitutes a preferred form, it is to be understood that other forms might be adopted.

We claim:

1. In an automatic ice maker including a support, a tray mounted for rotatable movement on said support, means for supplying liquid to said tray, temperature-responsive means for sensing the temperature of the liquid in said tray, means for freezing the liquid in said tray, an electric drive motor, a disc rotatively mounted on one side of a wall of said support, said motor operative to rotate said disc, means operated by said drive motor for rotating said tray and ejecting frozen liquid therefrom, bin means for collecting the frozen liquid ejected from said tray, electrical control circuit means for said ice maker and said motor, wherein the improvement comprises a plurality of circular cam tracks concentrically arranged on the face of said disc in opposed relation to said one side of said wall, each cam track formed with a predetermined cam profile, a plurality of through bores in said wall aligned in a common plane, said wall having a circuit board affixed on its opposite side, aperture means in said circuit board aligned with said bores, each bore having its principal axis aligned on the medial radius of one of the cam tracks, each of the bores having a cam follower pin located therein of a predetermined length exceeding the overall dimension between said wall one side and the outer surface of said circuit board, said circuit board having a plurality of flexible parallel spring blade switches cantilever affixed to the outer surface thereof, a contact on the free end of each said blade switch movable therewith, a plurality of stationary contacts affixed on said circuit board for contact by an associated blade switch contact, said control circuit means connecting said movable and stationary contacts, each said spring blade switch aligned on the principal axis of its associated follower pin such that an intermediate portion of each blade switch is contacted by the adjacent end of its associated follower pin, whereby said disc having a rest position resulting in one or more of the follower pins being biased by their associated blade switches into a first spaced relation with their associated cam tracks causing the movable contact on such blade switches to be in engagement with their associated stationary contact energizing portions of said control circuit means, said control circuit means interconnecting said liquid sensing means with said motor whereby upon said liquid freezing into ice pieces said motor is energized so as to initiate rotation of said disc, and whereby upon rotating said disc certain of the cam track profiles effecting a predetermined axial movement of selected ones of the follower pins to a second position causing the movable contact on their associated blade switches to move out of engagement with their associated stationary contact deactivating portions of said control circuit means, and whereby continued rotation of said disc resulting in selected ones of the blade switches returning their associated follower pins to their first positions causing the movable contact on their associated blade switches to move into engagement with their associated stationary contact, activating other portions of said control circuit means in response to rotation of said disc resulting in selected functions of said ice maker being performed in a predetermined sequence.

2. An electrical sequencing device for controlling the operation of an apparatus and comprising, support wall means, a disc rotatably mounted for movement in a substantially parallel plane adjacent one side of said support wall means, means for rotating said disc during operation of said apparatus, a plurality of side-by-side arranged cam tracks on said disc in opposed face-to-face relation to said one side of said support wall means, each cam track formed with a predetermined cam profile, through bore means extending from one side of said wall means to the opposite side thereof, said through-bore means having a plurality of bore portions, each bore portion having its principal axis aligned in tracking relation with one of the cam tracks, each bore portion freely guidingly enclosing a cam follower pin for reciprocal movement therein, each follower pin having a predetermined length exceeding the overall dimension between the sides of said support wall means, a plurality of flexible spring blade switches biasingly affixed for movement toward the opposite side of said wall means, each blade switch having a contact portion movable therewith, a plurality of stationary contacts affixed in relation to the opposite side of said wall means for selective contact by an associated blade switch contact portion, and a control circuit means for said apparatus including said movable contact portions and said stationary contacts, each blade switch having another portion aligned on the principal axis of its associated cam follower pin such that each blade switch contacts the adjacent end of its associated follower pin for axially biasing the pin for movement in its bore portion in one direction toward an associated cam track on said disc, respective cam track profiles of said disc resisting the biased movement of said pin for moving said blade switch contact portion away from its associated stationary contact, whereby during rotation of said disc certain of the cam track profiles cause predetermined sequential axial movement of selected ones of the follower pins in the opposite direction against the bias of its associated blade switch resulting in the to and fro movement of said pins in said bore means to effect the selected opening and closing of said stationary contacts by their respective blade switch contact portions, thereby to control the operation of said apparatus with said control circuit means.

3. An automatic ice maker having an electrical sequencing device for controlling the operation thereof and including a support providing support wall means for said sequencing device, a mold mounted on said support and adapted for freezing liquid therein, means adapted to be connected to a source of liquid for supplying liquid to fill said mold, temperature-responsive means for sensing temperature of the liquid in said mold, an electric drive motor, a disc rotatably mounted for movement in a substantially parallel plane adjacent one side of said support wall means, said motor operative for rotating said disc during operation of said ice maker, means operated by said drive motor for ejecting frozen liquid from said mold, a plurality of side-by-side arranged cam tracks on said disc in opposed face-to-face relation to said one side of said support wall means, each cam track formed with a predetermined cam profile, through-bore means extending from one side of said wall means to the opposite side thereof, said through-bore means having a plurality of bore portions, each bore portion having its principal axis aligned in tracking relation with one of the cam tracks, each bore portion freely guidingly enclosing a cam follower pin for reciprocal movement therein, each follower pin having a predetermined length exceeding the overall dimension between the sides of said support wall means, a plurality of flexible spring blade switches biasingly affixed for movement toward the opposite side of said wall means, each blade switch having a contact portion movable therewith, a plurality of stationary contacts affixed to the opposite side of said wall means for selective contact by an associated blade switch contact portion, an electrical control circuit means for said ice maker including respective pairs of said movable contact portions and said stationary contacts interconnecting said temperature-responsive means with said motor and said means for supplying liquid to said source of liquid, each blade switch having another portion aligned on the principal axis of its associated cam follower pin such that each blade switch contacts the adjacent end of its associated follower pin for axially biasing the pin for movement in its bore portion in one direction toward an associated cam track on said disc, respective cam track profiles of said disc resisting the biased movement of said pin for moving said blade switch contact portion away from its associated stationary contact, whereby upon said liquid freezing into ice pieces said motor is energized to initiate rotation of said disc so that certain of the cam track profiles cause predetermined sequential axial movement of respective ones of the follower pins in the opposite direction against the bias of its associated blade switch resulting in the to and fro movemen of said pins in said bore means to effect the selecte opening and closing of said stationary contacts by their respective blade switch contact portions for removing the frozen ice pieces from said mold and then refilling said mold with liquid.

* * * * *